US009387411B1

(12) United States Patent
Thompson

(10) Patent No.: US 9,387,411 B1
(45) Date of Patent: Jul. 12, 2016

(54) EDUCATIONAL TOY CAR

(71) Applicant: Timothy Thompson, Salt Lake City, UT (US)

(72) Inventor: Timothy Thompson, Salt Lake City, UT (US)

( * ) Notice: Subject to any disclaimer, the term of this patent is extended or adjusted under 35 U.S.C. 154(b) by 539 days.

(21) Appl. No.: 13/970,947

(22) Filed: Aug. 20, 2013

(51) Int. Cl.
*G09B 25/00* (2006.01)
*A63H 17/00* (2006.01)
*A63H 29/00* (2006.01)

(52) U.S. Cl.
CPC ..... *A63H 29/00* (2013.01)

(58) Field of Classification Search
USPC ..... 434/372, 373, 375, 376; 446/431, 448, 446/457, 460, 462, 465, 466, 468–471
See application file for complete search history.

(56) References Cited

U.S. PATENT DOCUMENTS 1,646,169 A * 10/1927 Fritz ..... A63H 29/04 446/464
1,763,302 A * 6/1930 Gilbert ..... A63H 33/042 446/113
2,113,750 A * 4/1938 Travis ..... A63H 29/18 180/54.2
2,346,225 A 4/1944 Marak
2,629,941 A 2/1953 Allgaier
2,639,544 A 5/1953 Coffin
2,726,482 A 12/1955 Roehrl
D217,272 S * 4/1970 Genin ..... D21/528
3,939,605 A * 2/1976 Allen ..... A63H 11/10 446/448
3,986,278 A * 10/1976 Valentine ..... G09B 25/02 40/621
3,991,488 A * 11/1976 Valentine ..... G09B 25/02 434/314
4,120,118 A * 10/1978 Mathews ..... A63H 17/002 434/219
D253,313 S 10/1979 Josvanger
5,090,934 A 2/1992 Quercetti
5,273,478 A 12/1993 Yamasaki
5,575,660 A * 11/1996 Hooks ..... G09B 25/02 434/373
6,371,767 B1 * 4/2002 Libby ..... G09B 25/02 296/205
6,457,977 B1 10/2002 Schiefele

* cited by examiner

*Primary Examiner* — Kurt Fernstrom
(74) *Attorney, Agent, or Firm* — Kyle A. Fletcher, Esq.

(57) ABSTRACT

The educational toy car includes a framework having a pair of rear wheels and a pair of front wheels. The front wheels are pivotably connected as well as rotatably connected with the framework, and rotate in concert with one another via a steering tie rod. The framework includes an engine block with a plurality of piston members that work in concert to visibly rotate a transmission member located elsewhere in the framework. The transmission member connects to a drive gear that includes a drive shaft extending rearwardly within the framework, and to in mechanical connection with a rear differential. The rear differential is in mechanical connection with the pair of rear wheels. The pair of rear wheels are rotatably connected with the framework, and are rotated upon movement of the piston members or the transmission member or the drive shaft or the rear differential.

16 Claims, 5 Drawing Sheets

EDUCATIONAL TOY CAR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of children's toys, more specifically, a toy car that includes a framework within which the drive train is visible and rotates upon rotational movement of one of the drive wheels.

SUMMARY OF THE INVENTION

An embodiment of the disclosure meets the needs presented above by generally comprising a framework having a pair of rear wheels and a pair of front wheels. The front wheels are pivotably connected as well as rotatably connected with the framework, and rotate in concert with one another via a steering tie rod. The framework includes an engine block with a plurality of piston members that work in concert to visibly rotate a transmission member located elsewhere in the framework. The transmission member connects to a drive gear that includes a mechanical connection with a rear differential. The rear differential is in mechanical connection with the pair of rear wheels. The pair of rear wheels are rotatably connected with the framework, and are rotated upon movement of the piston members or the transmission member or the drive shaft or the rear differential. The educational toy car includes all componentry associated with a vehicular drive train, and all componentry is visible from outside of the framework in order to teach and provide animated motion of all componentry associated with the vehicular drive train.

These together with additional objects, features and advantages of the educational toy car will be readily apparent to those of ordinary skill in the art upon reading the following detailed description of presently preferred, but nonetheless illustrative, embodiments of the educational toy car when taken in conjunction with the accompanying drawings.

In this respect, before explaining the current embodiments of the educational toy car in detail, it is to be understood that the educational toy car is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the educational toy car.

It is therefore important that the claims be regarded as including such equivalent construction insofar as they do not depart from the spirit and scope of the educational toy car. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
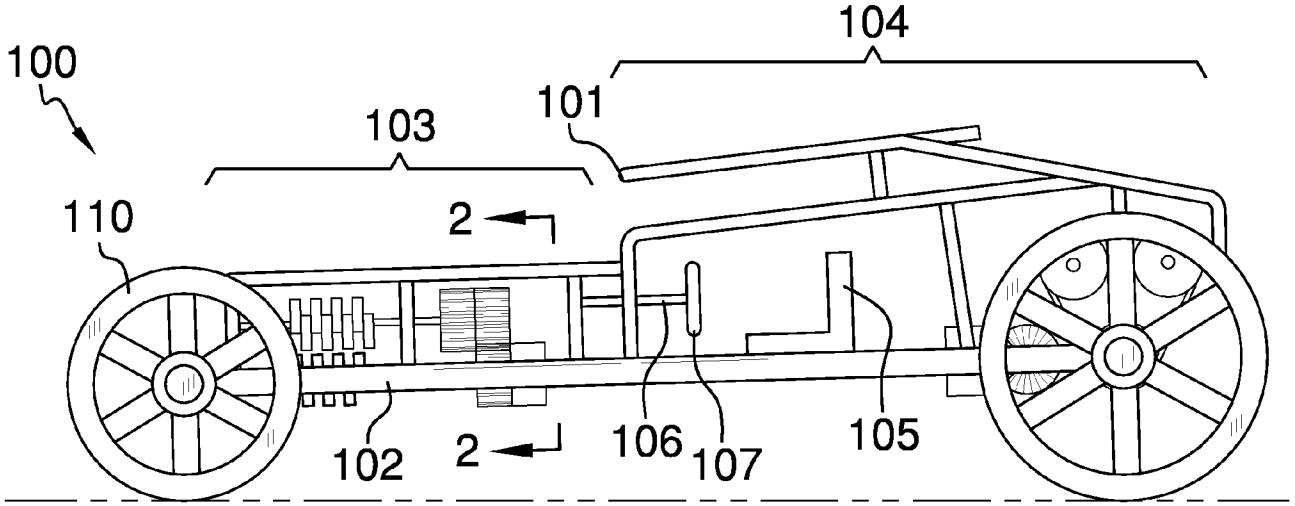
FIG. 1 is a side view of the educational toy car.
Figure 2:
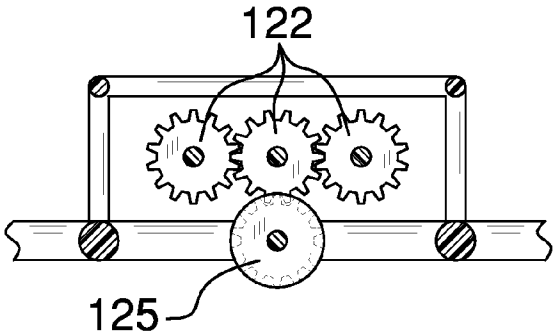
FIG. 2 is a cross-sectional view of the educational toy car along line 2-2 in FIG. 1.
Figure 3:
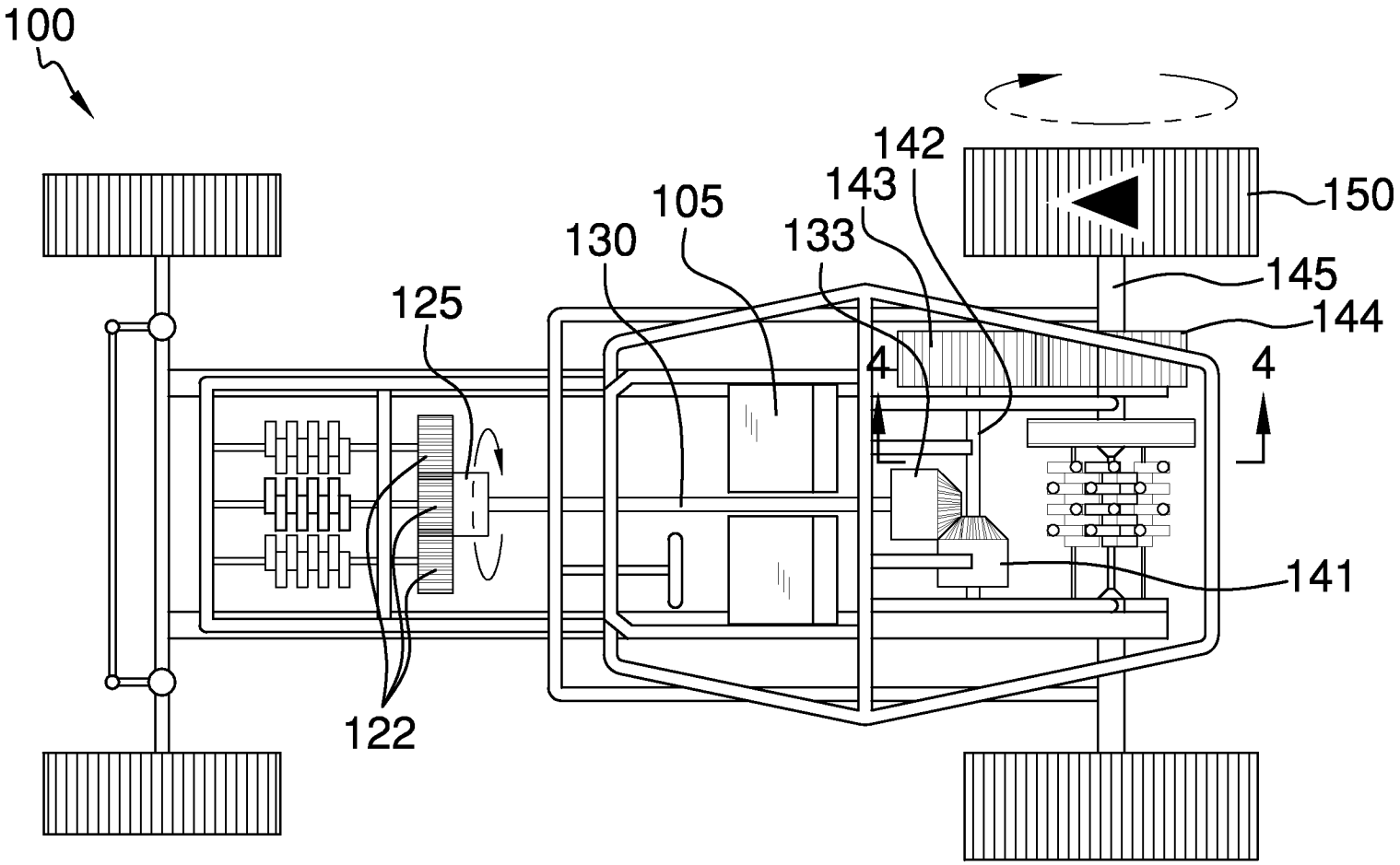
FIG. 3 is a top view of the educational toy car.
Figure 4:
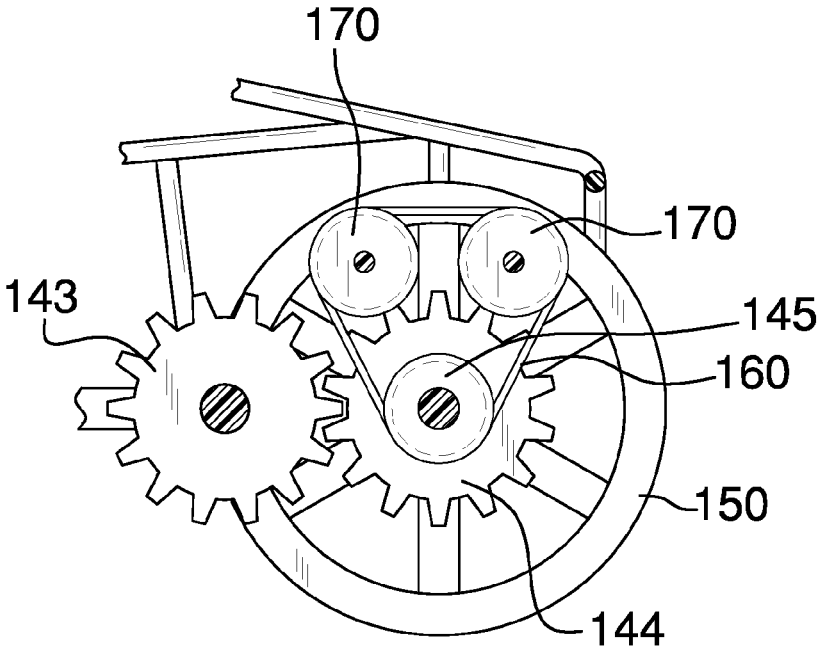
FIG. 4 is a cross-sectional view of the educational toy car along line 4-4 in FIG. 3.
Figure 5:
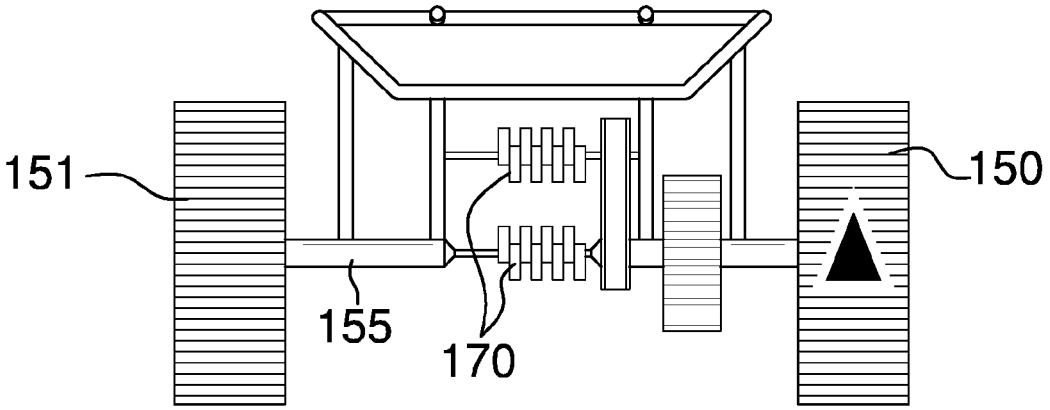
FIG. 5 is a rear detailed view of the educational toy car.
Figure 6:
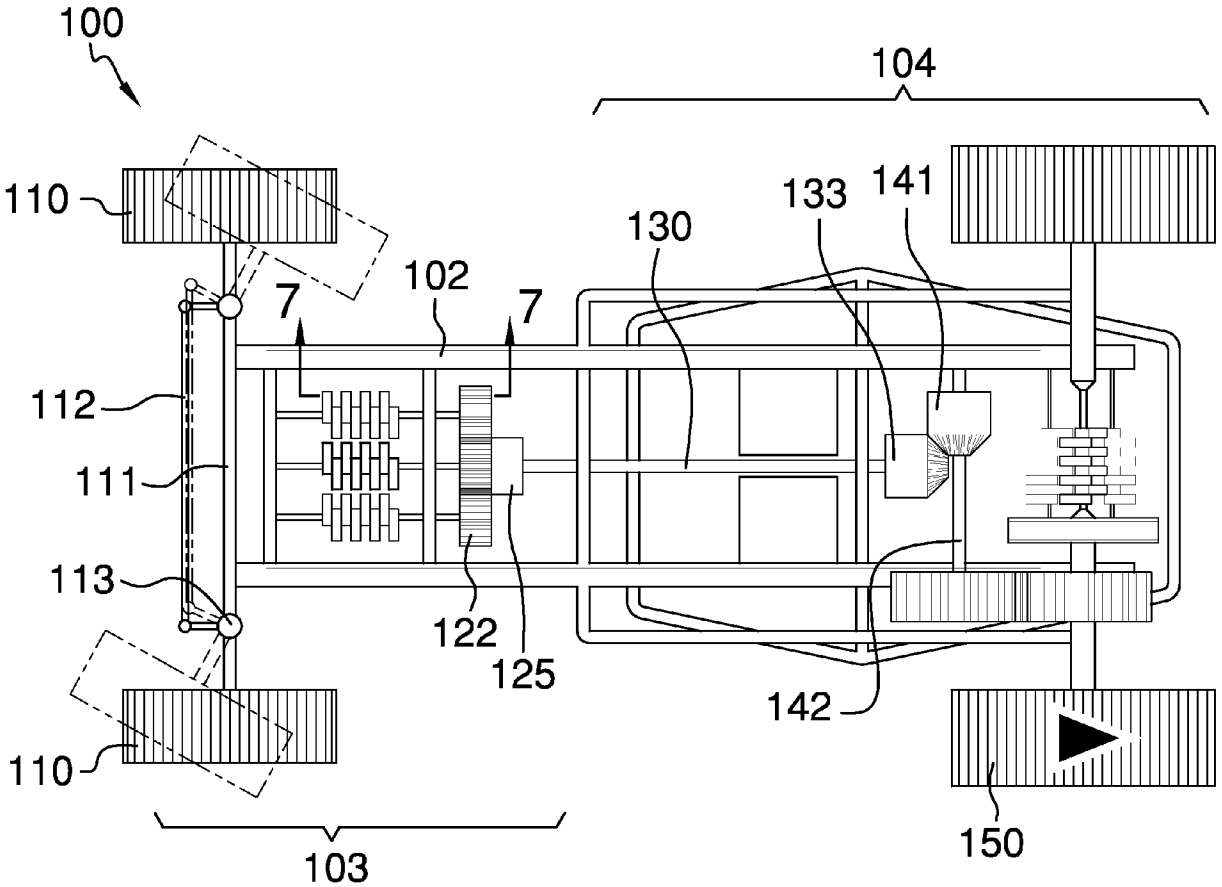
FIG. 6 is a bottom view of the educational toy car.
Figure 7:
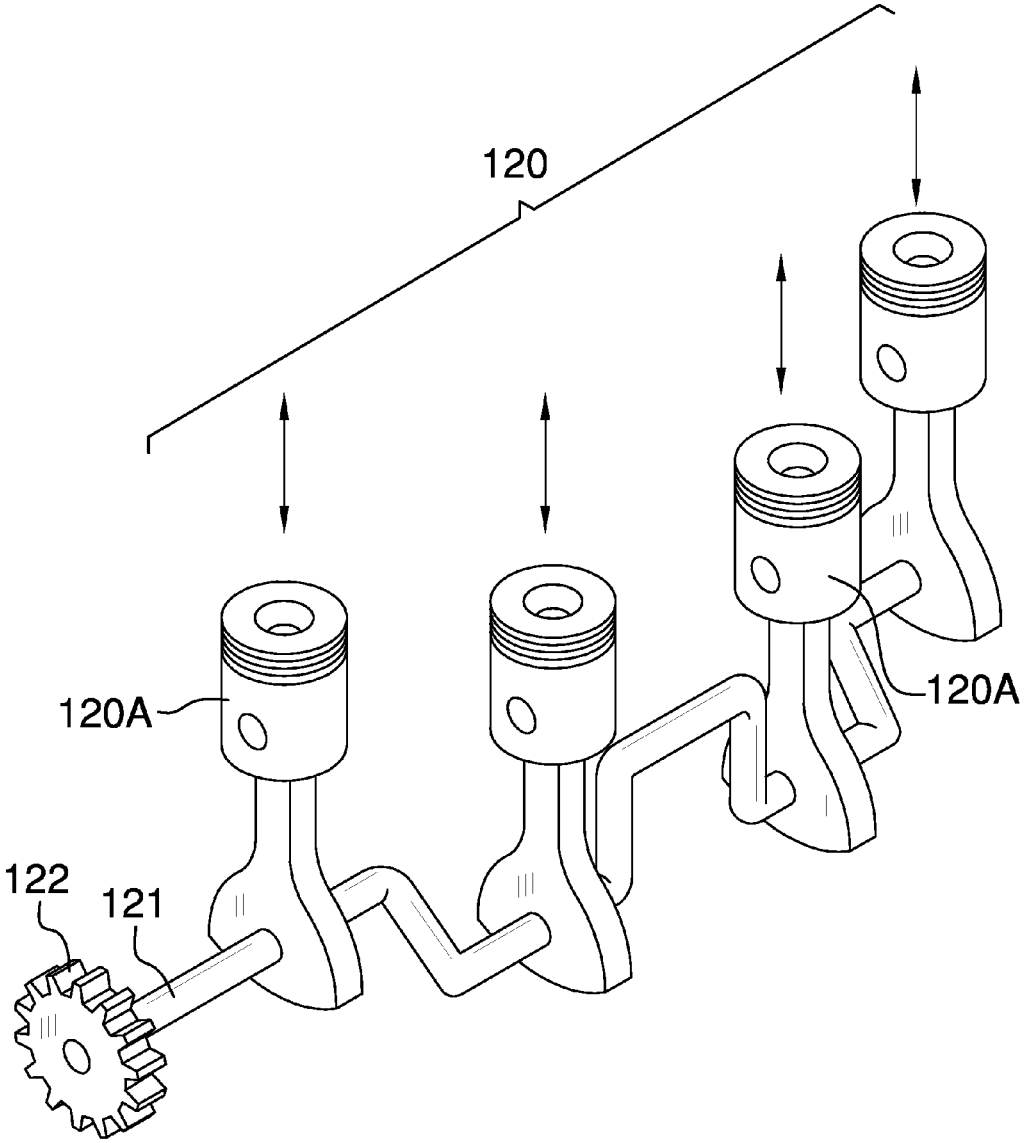
FIG. 7 is a cross-sectional perspective view of one of the piston members along line 7-7 in FIG. 6.

As best illustrated in FIGS. 1 through 7, the educational toy car 100 (hereinafter invention) generally comprises a framework 101 that is further defined with a chassis member 102 that spans along a bottom portion of the invention 100. The framework 101 includes an engine compartment portion 103, and occupant compartment 104. The occupant compartment 104 includes a seat 105, a steering column 106, and a steering wheel 107.

The invention 100 includes a pair of front wheels 110 that are pivotably as well as rotatably connected with the framework 101. Moreover, the pair of front wheels 110 connect to a forward framework member 111. The pair of front wheels 110 are connected to one another via a steering tie rod 112, which enables the pair of front wheels to pivot in concert (see FIG. 6). Moreover, the pair of front wheels 110 pivot with respect to front pivot points 113.

Located inside of the engine compartment portion 104 of the framework 101 is a plurality of piston members 120. The piston members 120 each include a plurality of individual pistons 120A, which are connected to a crank member 121. The crank member 121 rotates as the individual pistons 120A move up or down, and which is consistent with an internal combustion engine. The crank member 121 rotates and is in mechanical connection with a piston transfer gear 122. The piston members 120 all work in concert together, and connect to one another via the piston transfer gears 122. The piston transfer gears 122 collectively drive and rotate a piston drive gear 125.

The piston drive gear 125 is connected to a drive shaft 130 that extends rearwardly through a majority of the occupant compartment 104 to a rear differential 140. It shall be noted that the drive shaft 130 extends underneath the seat(s), and enables motion of the piston members 120 to be transferred to the rear differential 140, and vice versa. The rear differential 140 is constructed of a first differential gear 141 that is in mechanical connection with a rear drive shaft gear 133. The first differential gear 141 and the rear drive shaft gear 133 are perpendicularly oriented with respect to one another.

The first differential gear 141 is connected to and rotates with a first differential axle 142. The first differential axle 142 includes a second differential gear 143 on a distal end, which is in mechanical connection with a third differential gear 144. The third differential gear 144 connects with a rear differential axle 145 that is connected between a first rear wheel 150 and a fourth differential gear 145. The fourth differential gear 145 is connected with a belt member 160 that connects to differential belt drives 170. The differential belt drives 170 rotate a fifth differential axle 155 that extends to and connects and rotates with a second rear wheel 151.

The invention 100 is designed to illustrate and teach how a vehicular drive train and differential work. The invention 100 depicts a fundamental aspect of the internal combustion process by depicting motion of pistons and crankshafts, which in turn transfers linear movement to rotational movement that is transferred down the drive shaft to the differential.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An educational toy car comprising:

a framework that includes a pair of front wheels that are able to pivot and rotate with respect to said framework;

an engine compartment portion of the framework includes a plurality of piston members that visually depict linear motion of individual pistons to a crankshaft that in turn transfers rotational movement to a drive shaft that extends rearwardly underneath an occupant compartment of the framework;

wherein the drive shaft connects to a rear differential that distributes the rotational motion of the drive shaft to a first rear wheel and a second rear wheel;

wherein the educational toy car illustrates and teaches how a drive train of a vehicle operates.

2. The educational toy car according to claim 1 wherein the framework is further defined with a chassis member that spans along a bottom portion of the educational toy car; wherein the occupant compartment includes at least one seat, a steering column, and a steering wheel.

3. The educational toy car according to claim 2 wherein the pair of front wheels are pivotably as well as rotatably connected with the framework; wherein the pair of front wheels connect to a forward framework member; wherein the pair of front wheels are connected to one another via a steering tie rod, which enables the pair of front wheels to pivot in concert; wherein the pair of front wheels pivot with respect to front pivot points.

4. The educational toy car according to claim 3 wherein the piston members each include a plurality of the individual pistons, which are connected to a crank member; wherein the crank member rotates as the individual pistons move up or down; wherein the crank member rotates and is in mechanical connection with a piston transfer gear; wherein the piston members all connect and work in concert collectively, and connect to one another via the piston transfer gears.

5. The educational toy car according to claim 4 wherein the piston transfer gears collectively drive and rotate a piston drive gear; wherein the piston drive gear is connected to a drive shaft that extends rearwardly to the rear differential.

6. The educational toy car according to claim 5 wherein the drive shaft extends underneath said seat, and enables motion of the piston members to be transferred to the rear differential, and vice versa; wherein the rear differential is constructed of a first differential gear that is in mechanical connection with a rear drive shaft gear; wherein the first differential gear and the rear drive shaft gear are perpendicularly oriented with respect to one another.

7. The educational toy car according to claim 6 wherein the first differential gear is connected to and rotates with a first differential axle; wherein the first differential axle includes a second differential gear on a distal end, which is in mechanical connection with a third differential gear.

8. The educational toy car according to claim 7 wherein the third differential gear connects with a rear differential axle that is connected between a first rear wheel and a fourth differential gear.

9. The educational toy car according to claim 8 wherein the fourth differential gear is connected with a belt member that connects to differential belt drives; wherein the differential belt drives rotate a fifth differential axle that extends to and connects and rotates with the second rear wheel.

10. An educational toy car comprising:

a framework that includes a pair of front wheels that are able to pivot and rotate with respect to said framework;

an engine compartment portion of the framework includes a plurality of piston members that visually depict linear motion of individual pistons to a crankshaft that in turn transfers rotational movement to a drive shaft that extends rearwardly underneath an occupant compartment of the framework;

wherein the drive shaft connects to a rear differential that distributes the rotational motion of the drive shaft to a first rear wheel and a second rear wheel;

wherein the educational toy car illustrates and teaches how a drive train of a vehicle operates;

wherein the framework is further defined with a chassis member that spans along a bottom portion of the educational toy car; wherein the occupant compartment includes at least one seat, a steering column, and a steering wheel;

wherein the pair of front wheels are pivotably as well as rotatably connected with the framework; wherein the pair of front wheels connect to a forward framework member; wherein the pair of front wheels are connected to one another via a steering tie rod, which enables the pair of front wheels to pivot in concert; wherein the pair of front wheels pivot with respect to front pivot points.

11. The educational toy car according to claim 10 wherein the piston members each include a plurality of the individual pistons, which are connected to a crank member; wherein the crank member rotates as the individual pistons move up or down; wherein the crank member rotates and is in mechanical connection with a piston transfer gear; wherein the piston members all connect and work in concert collectively, and connect to one another via the piston transfer gears.

12. The educational toy car according to claim 11 wherein the piston transfer gears collectively drive and rotate a piston drive gear; wherein the piston drive gear is connected to a drive shaft that extends rearwardly to the rear differential.

13. The educational toy car according to claim 12 wherein the drive shaft extends underneath said seat, and enables motion of the piston members to be transferred to the rear differential, and vice versa; wherein the rear differential is constructed of a first differential gear that is in mechanical connection with a rear drive shaft gear; wherein the first differential gear and the rear drive shaft gear are perpendicularly oriented with respect to one another.

14. The educational toy car according to claim 13 wherein the first differential gear is connected to and rotates with a first differential axle; wherein the first differential axle includes a second differential gear on a distal end, which is in mechanical connection with a third differential gear.

15. The educational toy car according to claim 14 wherein the third differential gear connects with a rear differential axle that is connected between a first rear wheel and a fourth differential gear.

16. The educational toy car according to claim 15 wherein the fourth differential gear is connected with a belt member that connects to differential belt drives; wherein the differential belt drives rotate a fifth differential axle that extends to and connects and rotates with the second rear wheel.

* * * * *